US008353809B2

(12) United States Patent
Gere

(10) Patent No.: US 8,353,809 B2
(45) Date of Patent: Jan. 15, 2013

(54) METHOD AND DEVICE FOR FACILITATING USE OF AN EXERCISE BALL

(76) Inventor: Andrew Gere, Chico, CA (US)

( * ) Notice: Subject to any disclaimer, the term of this patent is extended or adjusted under 35 U.S.C. 154(b) by 0 days.

(21) Appl. No.: 13/465,010

(22) Filed: May 6, 2012

(65) Prior Publication Data

US 2012/0252638 A1 Oct. 4, 2012

Related U.S. Application Data

(63) Continuation of application No. 12/816,623, filed on Jun. 16, 2010, now Pat. No. 8,257,234.

(60) Provisional application No. 61/233,120, filed on Aug. 11, 2009.

(51) Int. Cl.
*A63B 21/00* (2006.01)
*A63B 26/00* (2006.01)
*A63B 71/00* (2006.01)

(52) U.S. Cl. ..... 482/142; 482/132; 482/139

(58) Field of Classification Search ..... 482/10–11, 482/23, 43, 51, 77, 91–96, 105, 111–112, 482/121–123, 129–133, 142, 148, 907; 383/6, 383/15, 22, 24; 206/315.1, 315.9, 315.91; 297/228.12, 485; 105/100, 107–108; *A63B 21/00, A63B 26/00, 71/00*

See application file for complete search history.

(56) References Cited

U.S. PATENT DOCUMENTS

| | | | |
|---|---|---|---|
| 4,097,086 | A | 6/1978 | Hudson |
| 6,030,034 | A | 2/2000 | Plohetski |
| 6,311,884 | B1 | 11/2001 | Johnson |
| 6,435,617 | B1 | 8/2002 | McNair |
| 6,475,125 | B1 | 11/2002 | Roberts |
| 7,160,028 | B1 | 1/2007 | Linday |
| 7,857,181 | B2 | 12/2010 | Sacks |
| 2004/0244115 | A1 | 12/2004 | Adams et al. |
| 2007/0265151 | A1 | 11/2007 | Ballard Olson |

*Primary Examiner* — Oren Ginsberg
(74) *Attorney, Agent, or Firm* — Temmerman Law Office; Mathew Temmerman

(57) ABSTRACT

A method for using an exercise device for facilitating a user to perform a variety of exercises using an exercise ball supported on the device is disclosed. The device comprises a pouch having a mouth end wherein the pouch is configured to form a seat portion to the user. The device further includes a plurality of linking members attached to the mouth end by an attachment means and a plurality of straps. The lower end of the plurality of straps is secured to the linking members and the upper end of the plurality of straps is attached to a securing means. Each of the pair of straps is crisscrossed in preparation for attachment to the exercise ball. The crisscrossed straps are looped around the ball and secured by using the securing means. The crisscross arrangement of the straps securely holds the exercise ball in relation to the seat portion.

10 Claims, 10 Drawing Sheets

METHOD AND DEVICE FOR FACILITATING USE OF AN EXERCISE BALL

CROSS-REFERENCE TO RELATED APPLICATIONS

This application is a continuation application of nonprovisional utility patent application Ser. No. 12/816,623, filed Jun. 16, 2010, which is currently pending and for which a notice of allowance has issued, and which was related to and claimed priority from provisional patent application Ser. No. 61/233,120, filed Aug. 11, 2009.

STATEMENT REGARDING FEDERALLY SPONSORED RESEARCH AND DEVELOPMENT

Not Applicable.

FIELD OF THE INVENTION

This invention relates to exercise devices, and more particularly to a device and method for facilitating the use of an exercise ball supported on an exercise device.

DISCUSSION OF RELATED ART

It is well known that the human spine accommodates movements in all four directions (forward, back, left side, right side) but that by far the most common movement made by any individual is to bend it forward. Sitting, sleeping, and for most individuals merely working all tend to bend the spine forward and over time create problems with it. There are means for relief such as chiropractors and medication, but these can be costly and time consuming.

One solution is the inversion table, which does relieve pressure from the lower back, but that does not bend the spine backwards. This solution is also costly and requires a large amount of storage space. Other types of back supports may bend the spine but do not take pressure off the lower back.

Exercise balls continue to gain in popularity as a means for exercise, rehabilitation, and pain alleviation. The main use for the exercise ball is to cause instability to an individual such that the individual will adapt, balance, and consequently engage the core muscles such as the abdominals and the back muscles. They are also used in physical therapy and in therapeutic techniques to treat adults with orthopedic or other medical problems. In addition to these techniques, many individuals sit on an exercise ball in place of a chair to engage the abdominal and back muscles and still other individuals use the exercise ball to bend the spine backwards and in particular the upper back. The exercise ball has thus become another solution to pain relief of the back.

In its simplest usage simply lean against while they engage in other activities, such as reading or watching television. However, two problems occur when one leans against an exercise ball to support his or her lower back. First, when a user sits on the floor to support the user's back and stretch the abdominal and pectoral muscles against the exercise ball, the ball may not necessarily be centered on the lower back of the user. Instead, the ball often actually centers on the user's mid to upper back. This does not conform to the natural curvature of the spine, and thus may be ineffective to take advantage of the fact that the curvature of the ball is very similar to the curvature of the lower back. In other cases, the ball does center on the lower back (because it is a smaller ball), but in these instances the ball may be so small that the curvature of the ball is significantly greater than the curvature of the lower back. There is thus a need to provide a means for bringing the side of a larger radius exercise ball coincident with the lower region of an individual's back.

A second problem encountered when one leans against an exercise ball is that the ball tends to slip away from the user during use. During use, any force exerted by the user onto the ball is by Newton's Third Law exerted back on the user. Thus, a "shoving match" with the ball ensues and the user is constantly in a state of tending to slide away from the ball. This is particularly frustrating to many users because it is the pressure against the ball that enhances the pain alleviation of the back. Even if the user were to place the ball against a relatively immovable object, such as a couch, the user would still tend to slide away from the ball. In some instances, the ball tends to have a much higher sliding friction than a rolling friction, and so the ball would tend to roll forward toward the user. In any event, the user is in a constant battle. One solution is to press against the ball directly from the top, so that gravity provides the constant force needed to stay in contact with the ball. This solution, however, is generally not comfortable for the user due to the force exerted by the leveraged forces of the head and legs.

There is thus a need for an exercise device to facilitate a user to perform a variety of exercises using an exercise ball with the ball supported on the device. Further, such a device would be economical, easy to use and highly portable. Such a device would allow the side of a larger diameter exercise ball to match up to a user's back. Such a device provides straps for securing the user to the exercise ball so that the user does not tend to move away from the exercise ball. Moreover, such a device would include a seat portion allowing the user to sit comfortably and relatively upright. These and other advantages are accomplished by the present invention.

SUMMARY OF THE INVENTION

The present invention is an exercise device for facilitating a user to perform a variety of exercises using an exercise ball while the ball supported on the device. The device disclosed herein comprises a pouch having a mouth end wherein the pouch is configured to form a seat portion for the user. The seat portion provides the user a comfortable place to sit as well as elevates the user's position relative to the exercise ball or other ball shaped object. The device further includes a plurality of linking members attached to the mouth end by an attachment means. The attachment means in the preferred embodiment comprises sewn straps of a textile material. The circular shaped linking members distribute pressure evenly around their circumference so that the attachment means are not ripped from the seat portion.

The device further comprises a plurality of straps each having an upper end and a lower end. The plurality of straps may include a pair of long straps and a pair of short straps. The lower end of the plurality of straps is secured to the plurality of linking members and the upper end of the plurality of straps may be attached with a securing means.

Each of the pair of straps is crisscrossed in preparation for attachment to the exercise ball. The exercise ball is placed over the mouth end of the pouch, in between the crisscrossed straps. The crisscrossed straps are looped around the exercise ball and secured by using the securing means. The crisscross arrangement of the straps securely holds the exercise ball in relation to the seat portion. The user may then sit on the seat portion and lean against the attached exercise ball. The user is elevated relative to the ball and the ground by virtue of the seat portion's thickness and by the upward force exerted on the seat portion by the plurality of linking members when the user leans back against the ball.

DETAILED DESCRIPTION OF THE PREFERRED EMBODIMENT

Figure 1:
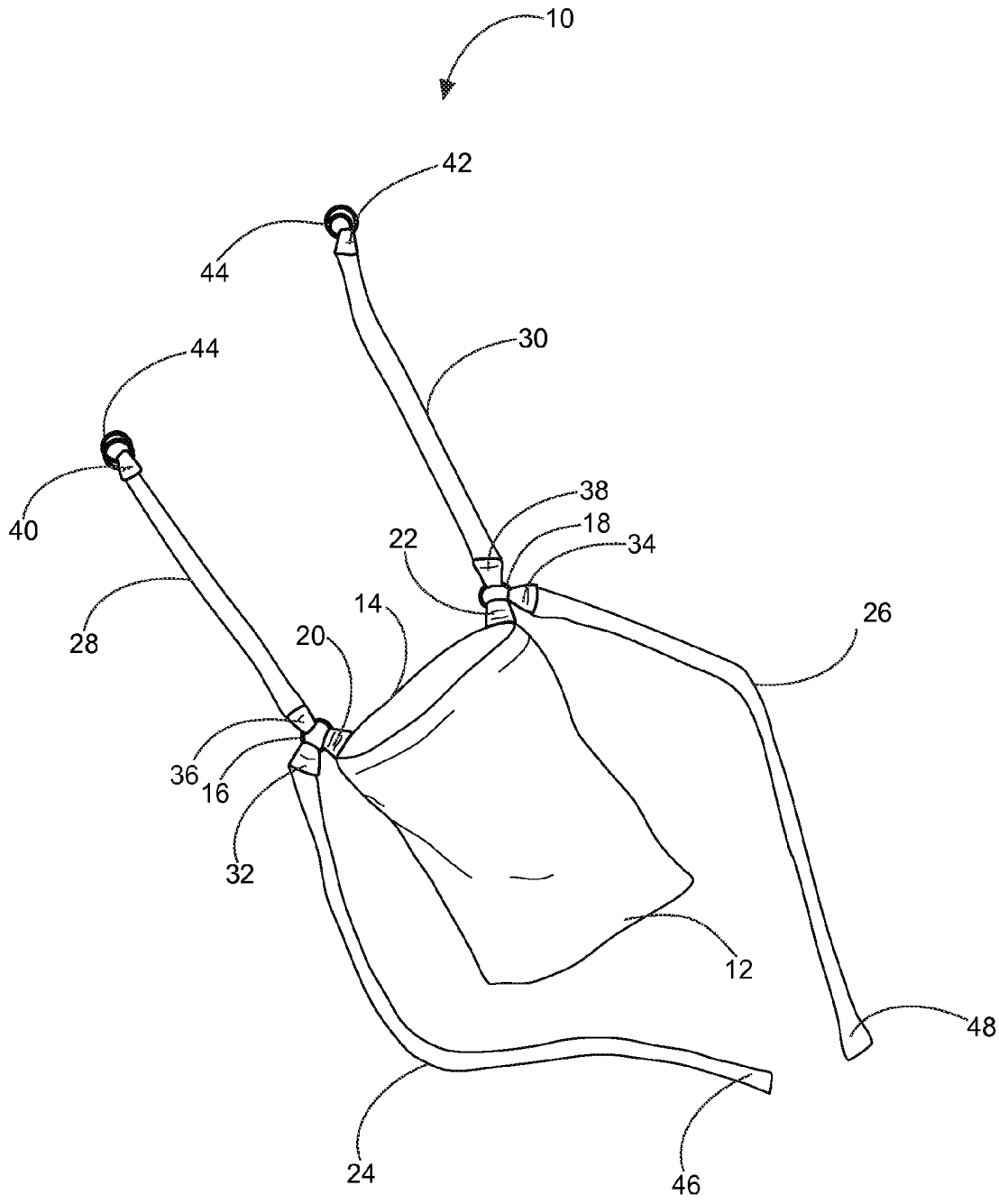
FIG. 1 is a perspective view of an exercise device according to a preferred embodiment of the present invention.

FIG. 1 is a perspective view of an exercise device 10 for facilitating a user (not shown) to perform a variety of exercises using an exercise ball (not shown) while the ball is supported on the device 10. The embodiment being indicated generally at 10 comprises a pouch 12 having a mouth end 14 wherein the pouch 12 is configured to form a seat portion to the user. The seat portion 12 provides the user a comfortable place to sit as well as elevates the user's position relative to the exercise ball or other ball shaped object (not shown). In the preferred embodiment of the present invention, the seat portion 12 is of a form similar to that of an oversized pillowcase, sufficiently large to contain a plurality of household pillows, and comprises an appropriate textile or other material. The seat portion 12 may be rendered in other forms such as molded plastics, shaped foams, woven materials, and various combinations thereof.

The device further includes a plurality of linking members 16, 18 attached to the mouth end 14 by an attachment means 20, 22. The attachment means 20, 22 comprises sewn straps of a textile material. The plurality of linking members 16, 18 are circular in shape. In the preferred embodiment, linking members 16, 18 may be made of steel, hardened plastic, or other appropriate material, and distribute pressure evenly around their circumference so that the attachment means 20, 22 are not ripped from the seat portion 12.

The device 10 further comprises a plurality of straps each having an upper end and a lower end. The plurality of straps may include a pair of long straps 24, 26 and a pair of short straps 28, 30. The lower end of the pair of long straps 32, 34 and the lower end of the pair of short straps 36, 38 are secured to the plurality of linking members 16, 18. The upper end of the pair of short straps 40, 42 may be attached with a securing means 44 and the upper end of the pair of long straps 46, 48 may be adapted to loop around the exercise ball and couple with the securing means 44. In an alternative embodiment the lower end of the pair of long straps 32, 34 and lower end of the pair of short straps 36, 38 are attached directly to the seat portion.

Figure 2:
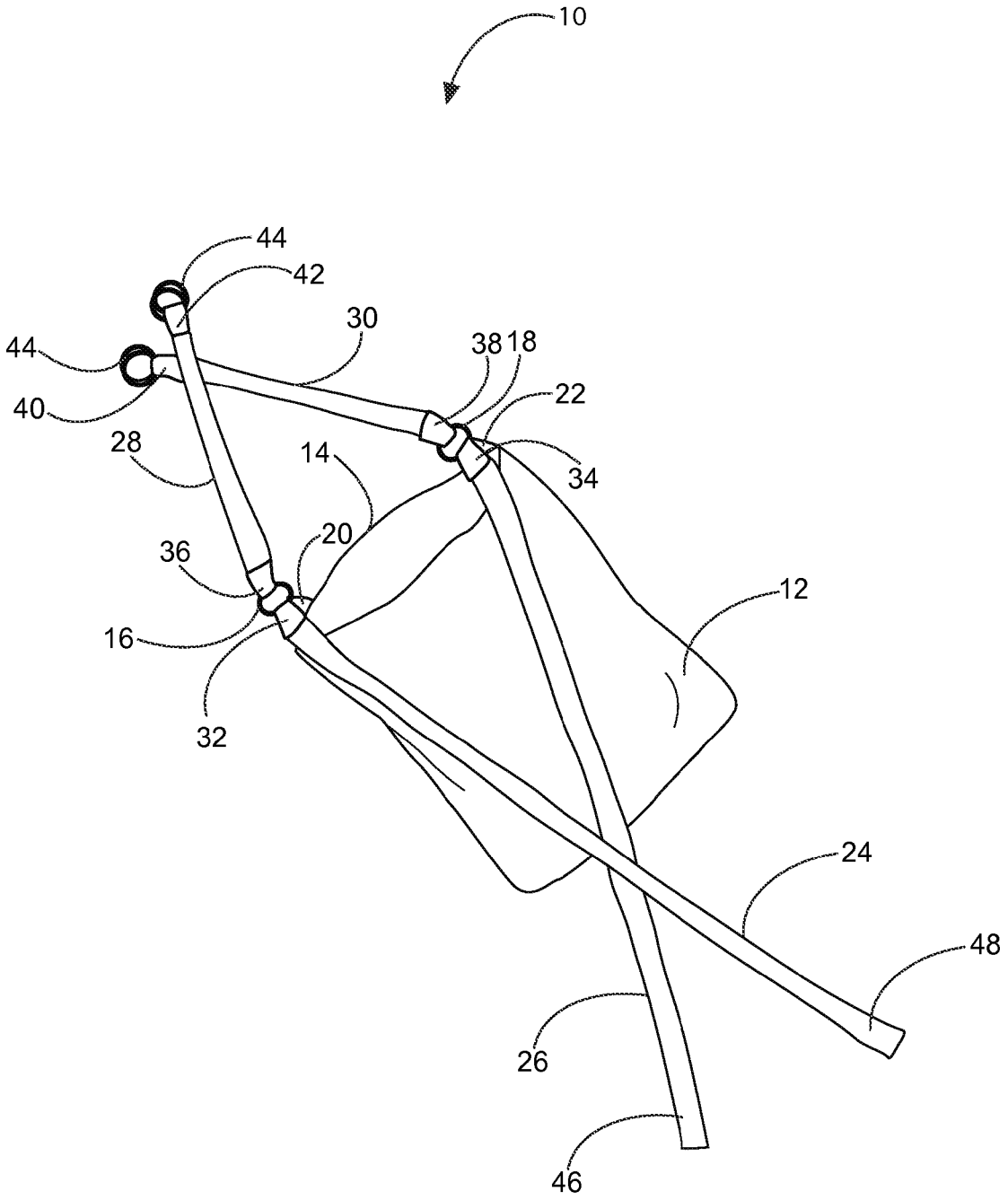
FIG. 2 is a top down view of the present invention, illustrating the device with a crisscrossed arrangement of top and bottom straps to secure an exercise ball.

FIG. 2 is a top down view of the present invention, wherein the device 10 illustrates a crisscrossed arrangement of long and short straps 24, 26, 28, 30 to secure the exercise ball (not shown). The pair of long straps 24, 26 and the pair of short straps 28, 30 are made of nylon, cotton or other appropriate textile material. The pair of long straps 24, 26 is sufficiently long to accommodate a wide range of sizes of the exercise balls (not shown). The pair of short straps 28, 30 is of an appropriate length that when used in conjunction with the pair of long straps 24, 26, the device 10 may be attached to and secure a wide variety of sizes of exercise balls (not shown).

Figure 3:
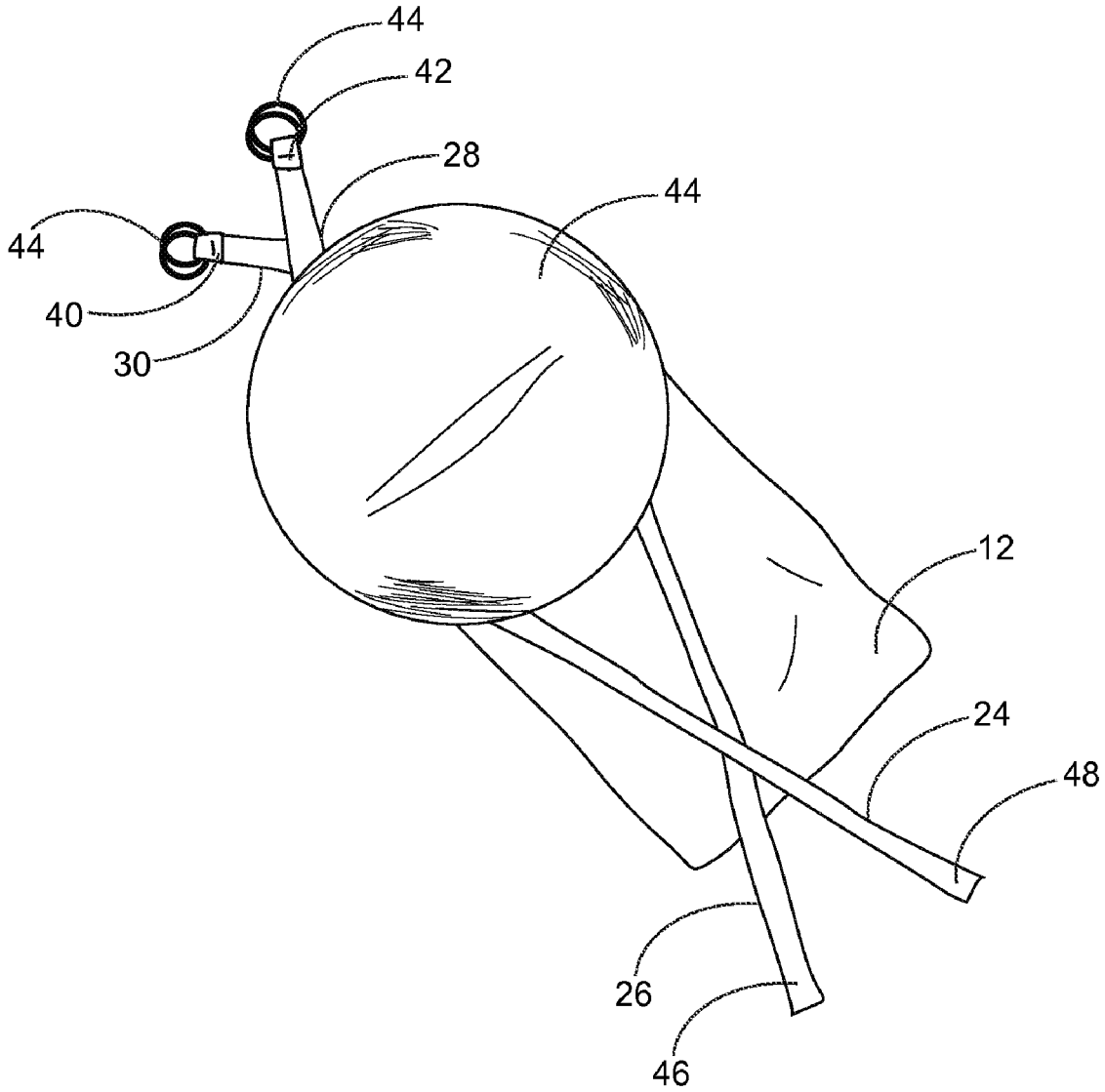
FIG. 3 is a top down view of the present invention, illustrating the exercise ball positioned for attachment to the present invention.

FIG. 3 is a top down view of the present invention, wherein the exercise ball 50 is positioned over the mouth end (not labeled in this Figure), in between the crisscrossed top straps 24, 26 and crisscrossed bottom straps 28, 30 for attachment with the device. As in FIG. 2, the long strap 24 is crossed over the long strap 26 and the short strap 28 is crossed over the short strap 30 in preparation for attachment to the exercise ball 50.

Figure 4:
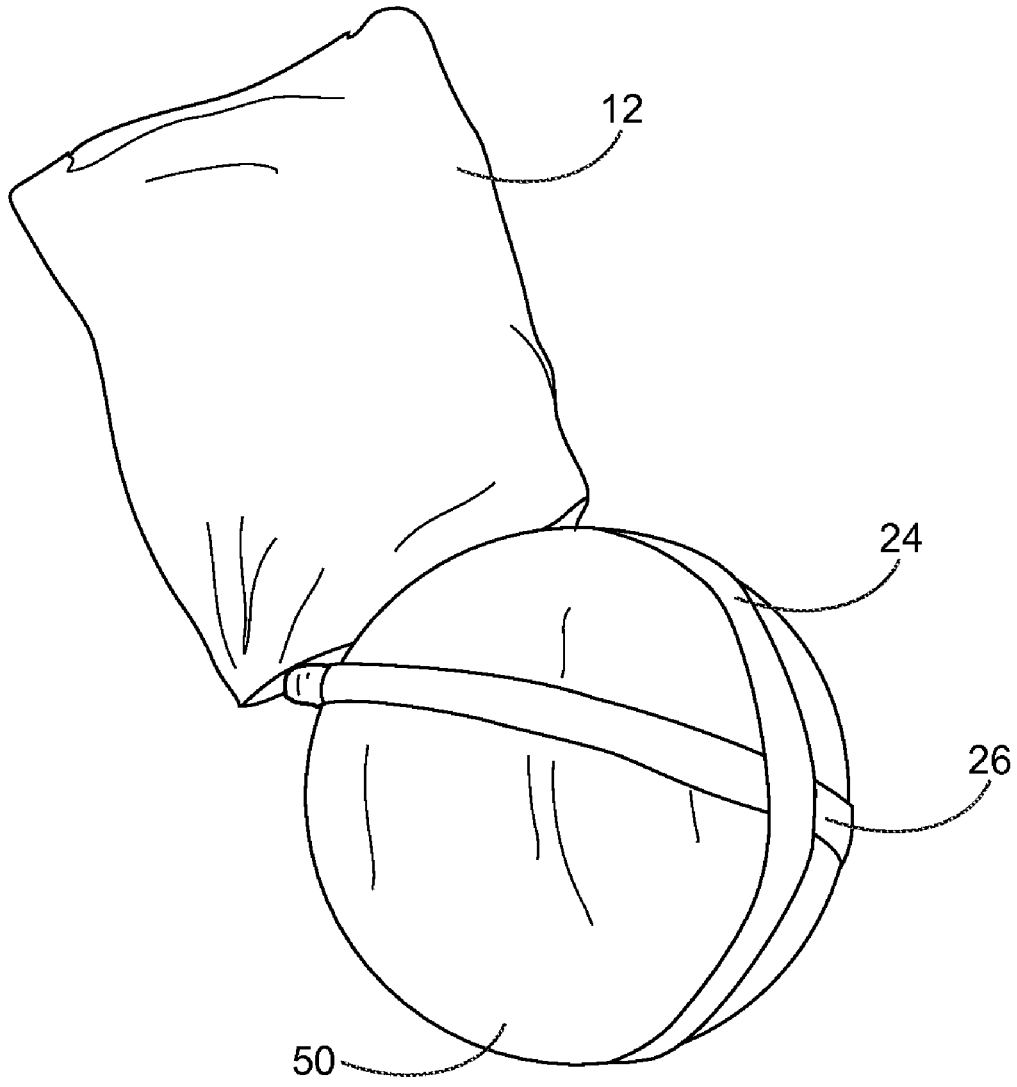
FIG. 4 is a perspective view of the present invention with the exercise ball looped thereto.
Figure 5:
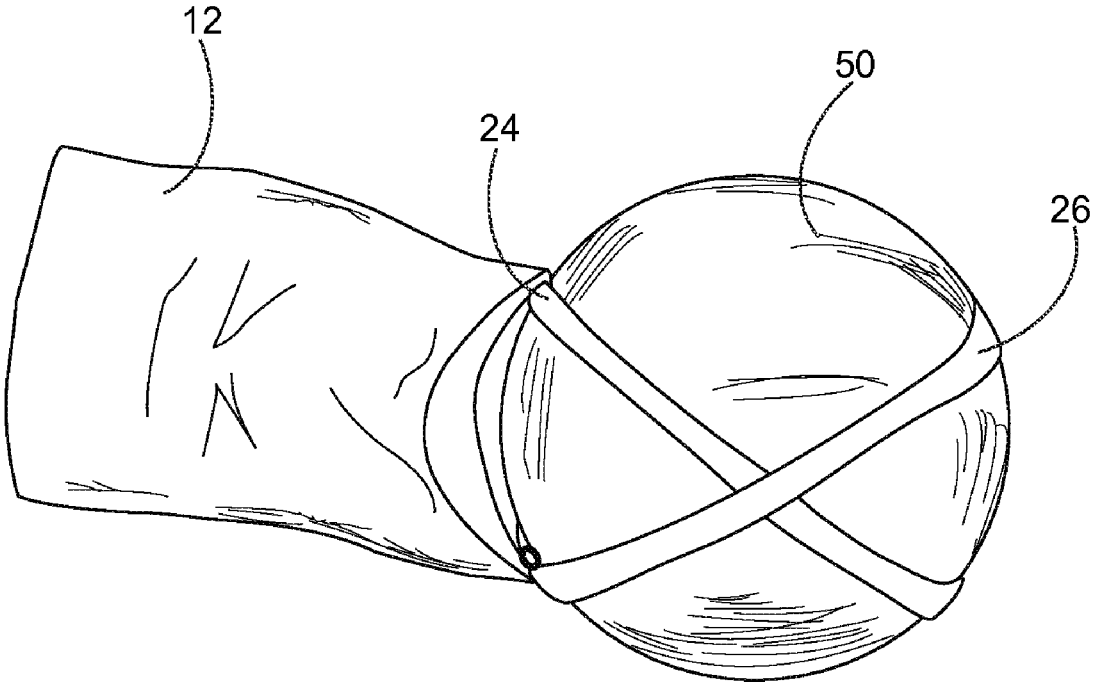
FIG. 5 is a top down view of the present invention with the exercise ball looped thereto.

The upper end of the pair of long straps 46, 48 is looped around the exercise ball 50 and coupled to the upper end of the pair of short straps 40, 42 by using the securing means 44 as illustrated in FIGS. 4 and 5. The securing means 44 may be selected from a group consisting of ring, buckle, tie and hook and loop fastener. The securing means 44 may be made of steel, hardened plastic or other appropriate material.

Figure 6:
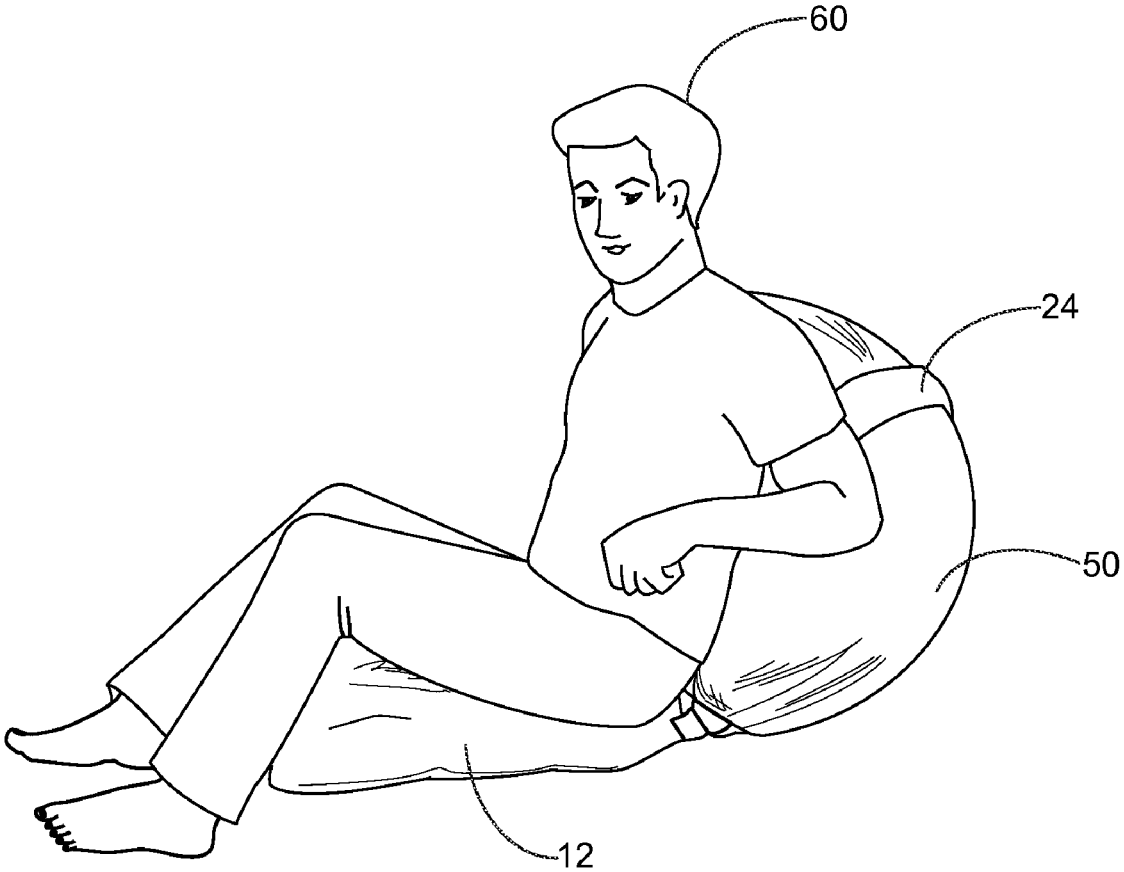
FIG. 6 is a perspective view of the present invention in use.
Figure 7:
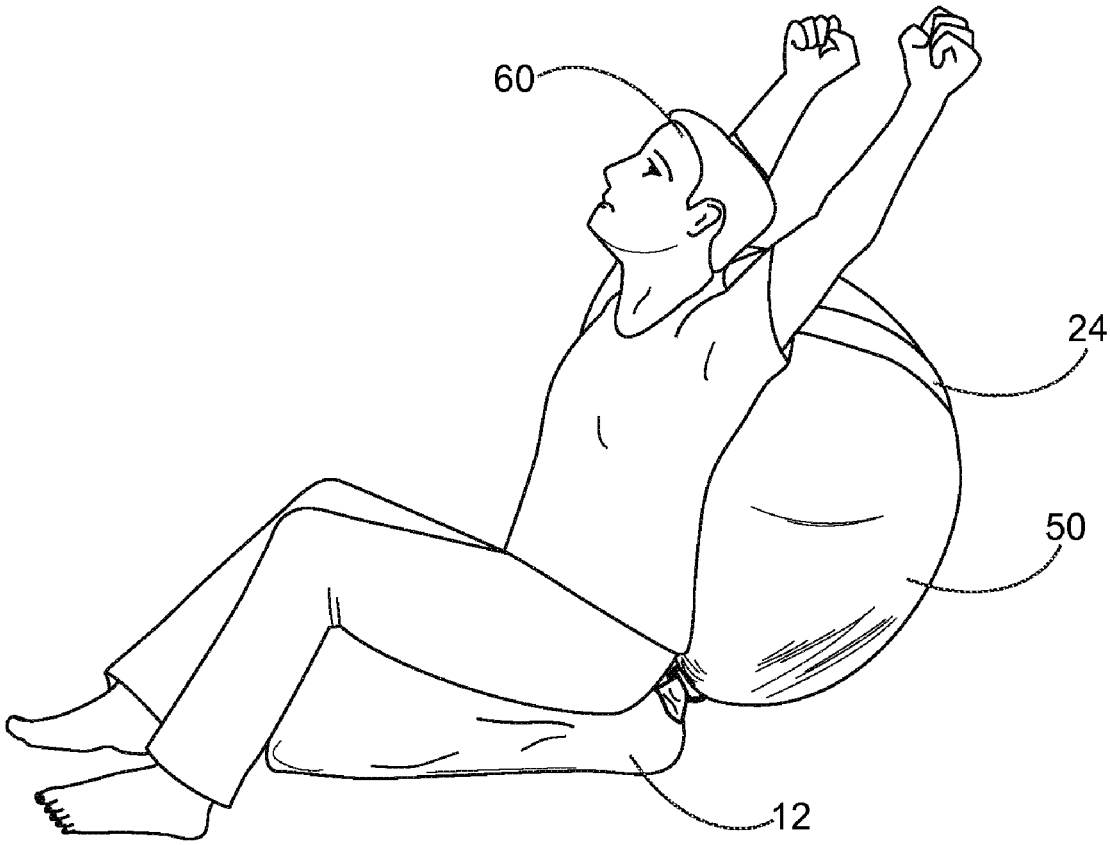
FIG. 7 is a perspective view of the present invention in use.

FIGS. 6 and 7 are the preferred embodiments of the invention when in use. The crisscross arrangement of long straps 24, 26 and short straps 28, 30 securely holds the exercise ball 50 in relation to the seat portion 12. In this preferred embodiment, the user 60 sits on the seat portion 12 and leans against the attached exercise ball 50. The user 60 is elevated relative to the ball 50 and the ground by virtue of the thickness of the seat portion 12 and by the upward force exerted on the seat portion 12 by the plurality of linking members 16, 18 when the user 60 leans back against the ball 50. The user 60 is thus suspended in a hammock-like structure with the ground at one end and the exercise ball 50 at the other. This arrangement of user 60, seat portion 12, and exercise ball 50 takes a substantial amount of pressure off the lower back, bends the spine backwards, and opens the chest and shoulders.

When the user 60 leans against the exercise ball 50 without the device 10 attached thereto, the ball 50 exerts a force on the user 60 equal to the force exerted by the user 60 on the ball 50. This tends to push the user 60 and the ball 50 away from one another. Upon use of the device 10, the user 60 and the ball 50 are tethered so that all forces are internal. That is, the force imparted by the ball 50 is transferred through the seat portion 12 back to the ball 50 until equilibrium is reached, and no force exits the system to require an opposing force by the user's legs or feet. In consequence, the user 60 tends to not slide away from the ball 50 and the ball 50 tends to not slide away from the user 60.

Figure 8:
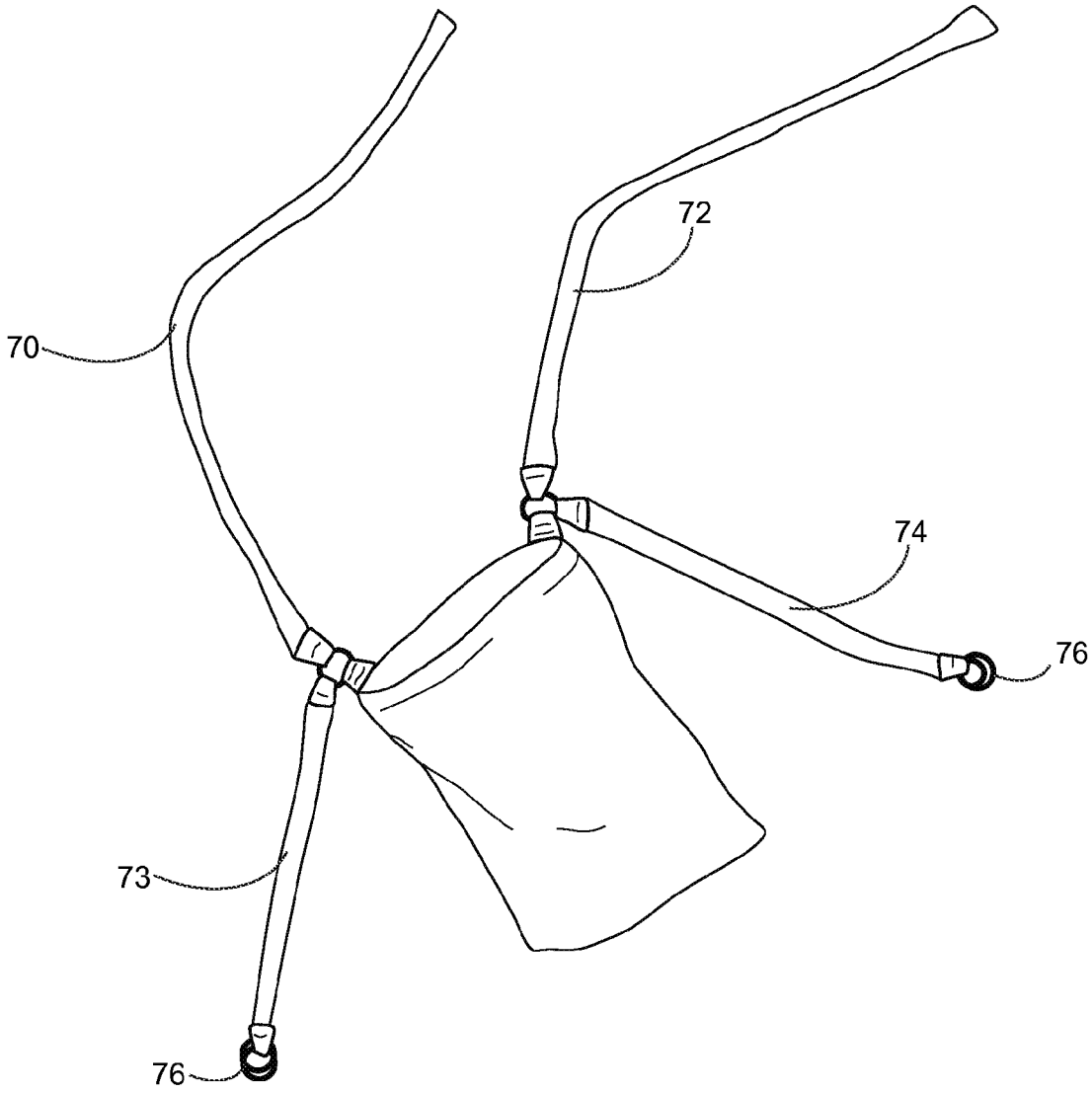
FIG. 8 is a perspective view of one embodiment of the present invention.
Figure 9:
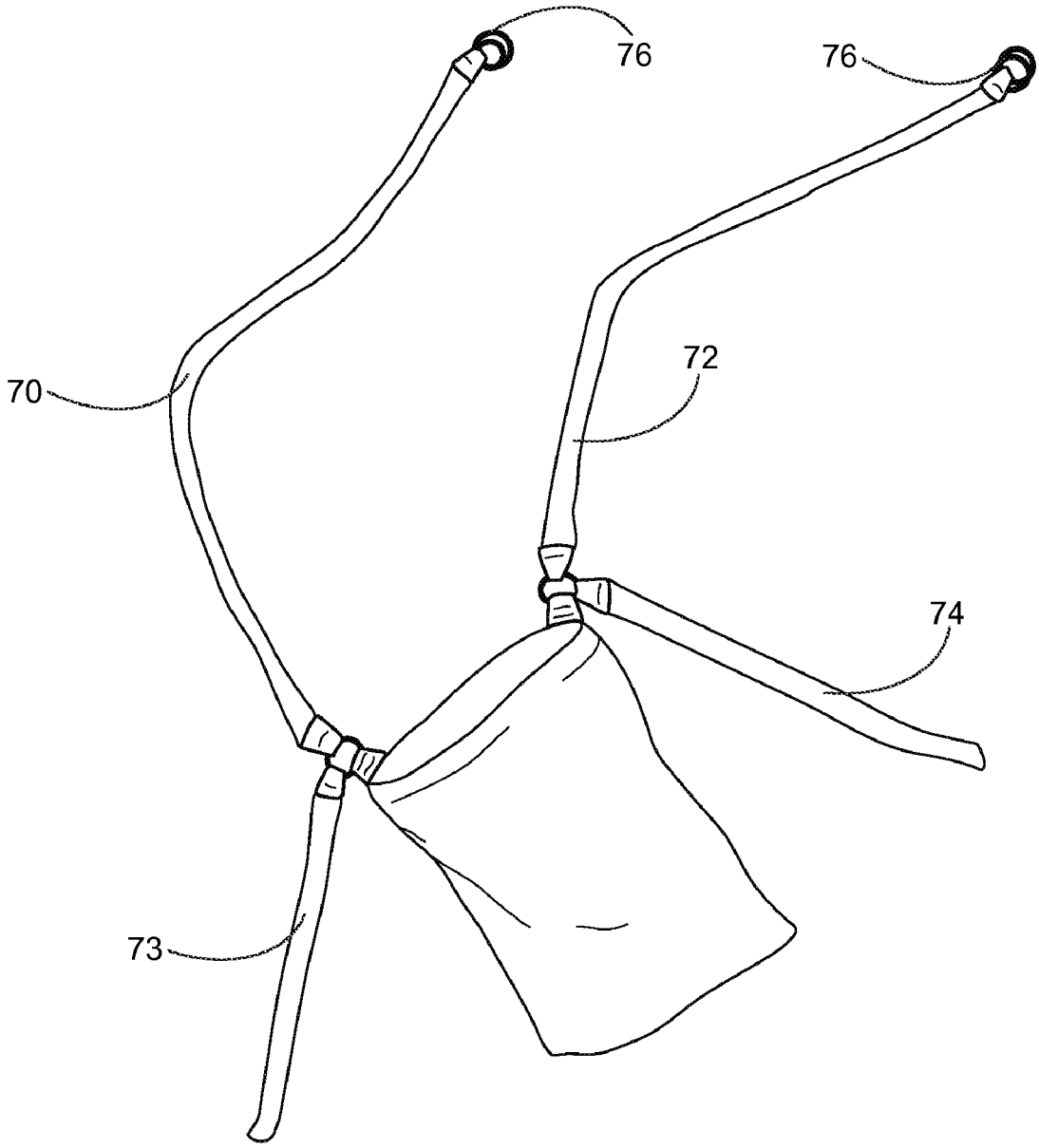
FIG. 9 is a perspective view of another embodiment of the present invention.
Figure 10:
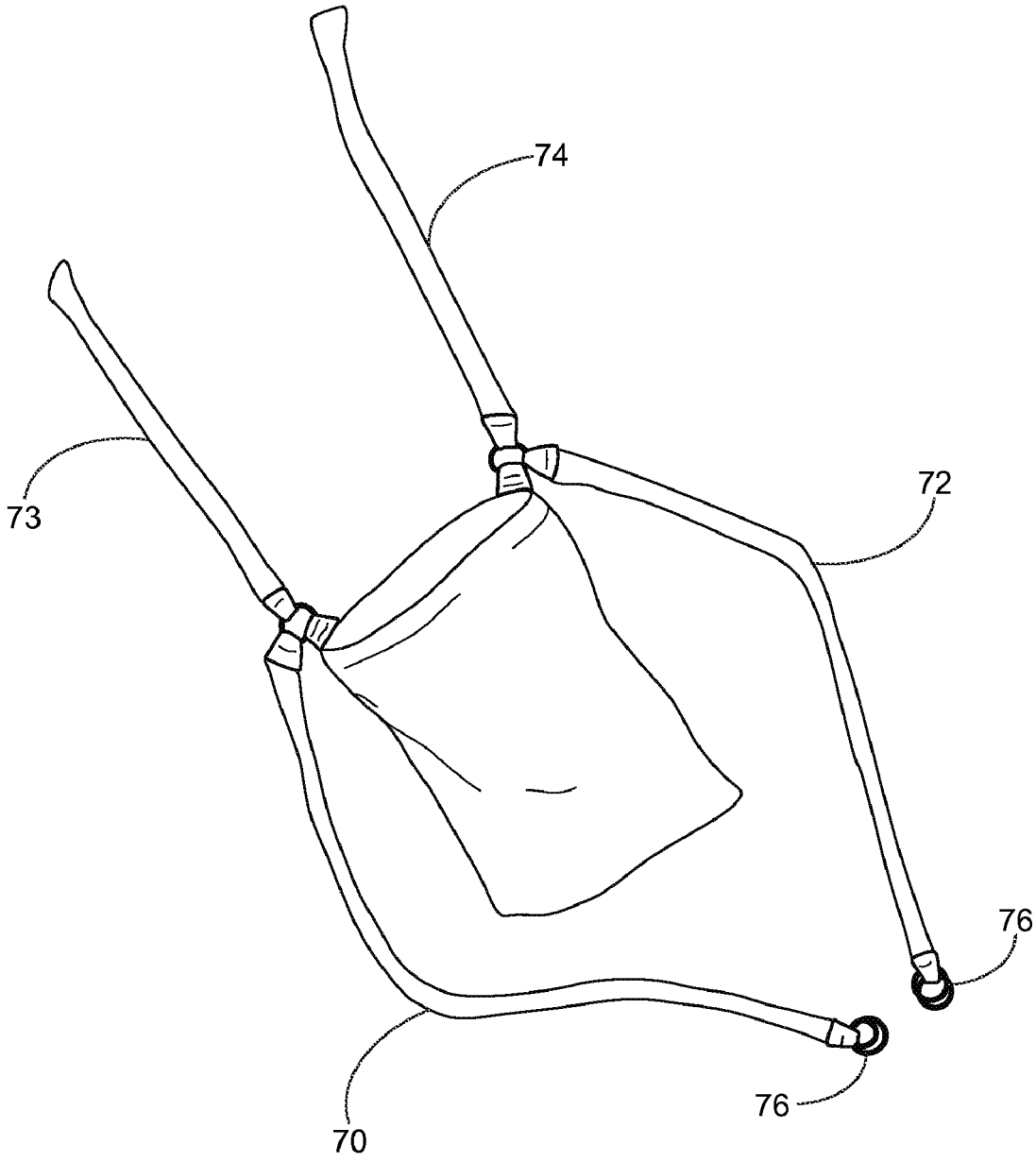
FIG. 10 is a perspective view of yet another embodiment of the present invention.

The embodiments of the exercise device 10 illustrated in the FIGS. 8, 9 and 10 show the different possible arrangements of a pair of long straps 70, 72, and a pair of short straps 73, 74. A securing means 76 may be attached to an upper end of any of the pair of straps, or not shown, the straps may be tied together. In addition, the straps may all be of equal length, so long as they are long enough to be secured together around the ball as shown in the previous figures.

While a particular form of the invention has been illustrated and described, it will be apparent that various modifications can be made without departing from the spirit and scope of the invention. For example, the exercise device 10 may incorporate a plurality of straps for securing the exercise ball and may use common use items such as exercise ball or other suitable sphere and pillows. Accordingly, it is not intended that the invention be limited, except as by the appended claims.

I claim:

1. A method for facilitating the use of an exercise ball supported on an exercise device to perform a variety of exercises by a user, the method comprising:

a. providing the exercise device having a pouch configured to form a seat portion to the user and a plurality of straps;
b. crisscrossing one pair of the straps;
c. crisscrossing another pair of the straps;
d. placing the exercise ball over a mouth end of the pouch, in between the crisscrossed straps;
e. looping the crisscrossed straps around the exercise ball and securing the ball using a securing means; and
f. utilizing the seat portion as a seat for the user and leaning against the exercise ball supported on the exercise device.

2. The method of claim 1, wherein the seat portion comprises a pillowcase.

3. The method of claim 1, wherein the user is elevated relative to the exercise ball by virtue of the seat portion's thickness and the upward force exerted on the seat portion by a plurality of linking members when the user leans back against the exercise ball.

4. The method of claim 1, wherein the securing means is selected from a group consisting of rings, buckles, ties and hook and loop fasteners.

5. The exercise device of claim 1, wherein the plurality of straps includes at least two pairs of straps.

6. A method for facilitating the use of an exercise ball supported on an exercise device to perform a variety of exercises by a user, the method comprising:

a. providing the exercise device having a pouch configured to form a seat portion to the user and a plurality of straps;
b. placing the exercise ball on top of the pouch;
c. looping the plurality of straps at least partially around the ball and securing the ball using a securing means; and
d. utilizing the seat portion as a seat for the user and leaning against the exercise ball supported on the exercise device.

7. The method of claim 6, wherein the user is elevated relative to the exercise ball by virtue of the seat portion's thickness and the upward force exerted on the seat portion by the plurality of straps when the user leans back against the exercise ball.

8. The method of claim 6, wherein the securing means is selected from a group consisting of rings, buckles, ties and hook and loop fasteners.

9. The method of claim 6, wherein the seat portion comprises a pillowcase.

10. The method of claim 6, wherein the plurality of straps includes at least two pairs of straps.

* * * * *